33-261 SR
8/6/85 XR 4,532,717

United States Patent [19]

Watson et al.

[11] Patent Number: 4,532,717

[45] Date of Patent: Aug. 6, 1985

[54] BOW SIGHT

[76] Inventors: Ira L. Watson; Craig V. Watson, both of 7377 W. Fremont Dr., Littleton, Colo. 80123

[21] Appl. No.: 516,924

[22] Filed: Jul. 25, 1983

[51] Int. Cl.[3] ..... F41G 1/00

[52] U.S. Cl. ..... 33/265; 33/261

[58] Field of Search ..... 33/265, 261

[56] References Cited

U.S. PATENT DOCUMENTS

| | | | |
|---|---|---|---|
| 2,669,023 | 2/1954 | Pizzuti | 33/265 |
| 3,568,323 | 3/1971 | Lendway | 33/265 |
| 4,162,579 | 7/1979 | James | 33/265 |
| 4,224,741 | 9/1980 | Perry | 33/265 |

FOREIGN PATENT DOCUMENTS

| | | | |
|---|---|---|---|
| 1914783 | 9/1970 | Fed. Rep. of Germany | 33/265 |

*Primary Examiner*—William D. Martin, Jr.
*Attorney, Agent, or Firm*—Klaas & Law

[57] ABSTRACT

A bow sight for use with an archery bow comprising: a bracket for mounting the bow sight on a lateral surface of a bow riser; a sight wheel operably mounted on the bracket for selective incremental rotation relative the bracket about a central rotational axis positioned perpendicular the trajectory of an arrow shot from the bow; a sight pin operably mounted on the sight wheel for providing a sighting point for use by an archer in aiming the bow; attachment apparatus for operably rotatably attaching the sight wheel to the bracket; a biasing device for frictionally biasing the sight wheel against rotation relative the bracket; and marker devices selectively mounted in predetermined position about a circumferential portion of the sight wheel for calibrating the bow sight for a plurality of shooting distances.

18 Claims, 10 Drawing Figures

BOW SIGHT

BACKGROUND OF THE INVENTION

The present invention deals with bow sights for use on an archer's bow and more particularly to bow sights having a single sighting pin which may be positioned laterally and vertically relative a riser portion of the bow through manipulation of the bow sight.

Many types of sighting devices have been developed for use in association with an archer's bow. The sights generally employ one or more points which may be fixed at a predetermined position relative the bow riser. An archer using the sight aligns the sighting point with an intended target. The relative vertical position of the sighting point on the bow riser effects the vertical trajectory of an arrow being shot from the bow since by causing the archer must raise or lower the bow handle in a pivotal movement about the bow string anchor point in order to align the sighting point with the target. The bow string anchor point is the position to which the archer draws the bow string prior to releasing the arrow. In orthodox methods of shooting, the anchor point is positioned a short distance below the archer's eye level, usually in the vacinity of his mouth or chin. A relatively high position of the sighting pin causes the bow to be pivoted downwardly relative the anchor point and is used at relatively short shooting distances whereas a relatively low position of the sight pin causes the bow to be pivoted upwardly relative the anchor point and corresponds to longer shooting distances.

Bow sights may generally be divided into two categories. In the first category are bow sights having a plurality of fixed pins or having a plate with a plurality of fixed holes therein. The various pins or holes generally correspond to various shooting distances at which the archer may use the bow. A problem with this type device, especially in hunting, is that an archer may aim with the wrong reference pin. Bow sights in this first category are described in Lendway U.S. Pat. No. 3,568,323 and Keller U.S. Pat. No. 4,120,096.

Bow sights in the second category, which include the bow sight of the present invention, are those utilizing a single moveable sighting point. Bow sights in this second category include Leafstrand U.S. Pat. No. 2,667,692; Allen U.S. Pat. No. 3,718,979; Pennington U.S. Pat. No. 3,013,336; Harrington U.S. Pat. No. 3,271,863; Duplechin U.S. Pat. No. 3,521,362; and Perry U.S. Pat. No. 4,224,741. In this type of bow sight the sighting pin is provided in moveable relationship relative the bow handle allowing the sighting point to be repositioned for different shooting distances. It has been difficult in the past to provide a bow sight of this type which is readily adjustable without being unstable. Most prior art devices have utilized a lever arm having various associated locking devices to lock the arm at a desired position. A problem with this type of arrangement is that the locking step requires additional time which may not be available in hunting situations. In addition, such lever arm type devices have proved to be somewhat delicate and subject to bending and twisting, especially when the arm is in a locked position.

It is an object of the present invention to provide a bow sight for an archery bow which is readily adjustable both vertically and laterally and which maintains a fixed position relative the bow without use of a locking device.

It is a further object of the present invention to provide a bow sight which is relatively sturdy and which resists both bending and twisting deformations.

It is a further object of the present invention to provide a bow sight which is mountable on a lateral side surface of a bow riser.

It is a further object of the present invention to provide a bow sight which may be provided with multiple sight wheels for replaceable use on a single mounting bracket for calibration with different types of arrows.

It is a further object of the present invention to provide a bow sight having a plurality of selectively positionable marker devices associated therewith for calibrating the bow sight for various shooting distances.

It is a further object of the invention to provide a symmetrical bow sight which may be positioned in forwardly or rearwardly projecting relationship relative a blow riser.

It is a further object of the present invention to provide a bow sight which may be used interchangeably with left-handed or right-handed bows.

It is a further object of the present invention to provide a bow sight which is relatively inexpensive to construct.

It is a further object of the present invention to provide a bow sight which can be adjusted with one hand.

It is a further object of the present invention to provide a bow sight which provides a high degree of shooting accuracy.

It is a further object of the present invention to provide a bow sight which may be used for hunting or target shooting.

It is a further object of the present invention to provide a bow and bow sight assembly in which a sight wheel is mounted directly on a riser portion of the bow.

SUMMARY OF THE INVENTION

The present invention includes a bow sight for use with an archery bow comprising: bracket means for mounting the bow sight on a lateral surface of a bow riser; sight wheel means operably mounted on the bracket means for selective incrimental rotation relative the bracket about a central rotational axis positioned perpendicular to the trajectory of an arrow shot from the bow; sight pin means operably mounted on the sight wheel means for providing a sighting point for use by an archer in aiming the bow; attachment means for operably rotatably attaching the sight wheel means to the bracket means; biasing means for frictionally biasing the sight wheel means against rotation relative the bracket means; and marker means selectively mountable in predetermined position about a circumferential portion of the sight wheel means for calibrating the bow sight for a plurality of shooting distances.

The invention also includes an archery bow and bow sight assembly comprising: an archery bow having a riser portion positioned above a handle portion, the riser portion having an arrow receiving side and a nonarrow receiving side, the nonarrow receiving side of the bow comprising sight wheel mounting means for rotatably mounting a sight wheel thereon, pointer means for providing a fixed comparative reference point proximate a circumferential edge portion of the sight wheel means; and a bow sight having sight wheel means mounted for rotation about a central rotational axis for supporting a sight pin thereon; sight wheel attachment means for rotatably attaching the sight wheel to the sight wheel mounting means; and sight wheel marking means for cooperating with the pointer means for indicating rotational orientations of the sight wheel means relative the bow riser whereby the sight wheel means is repeatingly selectively positional at a plurality of predetermined rotational orientation relative the bow riser.

DETAILED DESCRIPTION OF THE INVENTION

Figure 1:
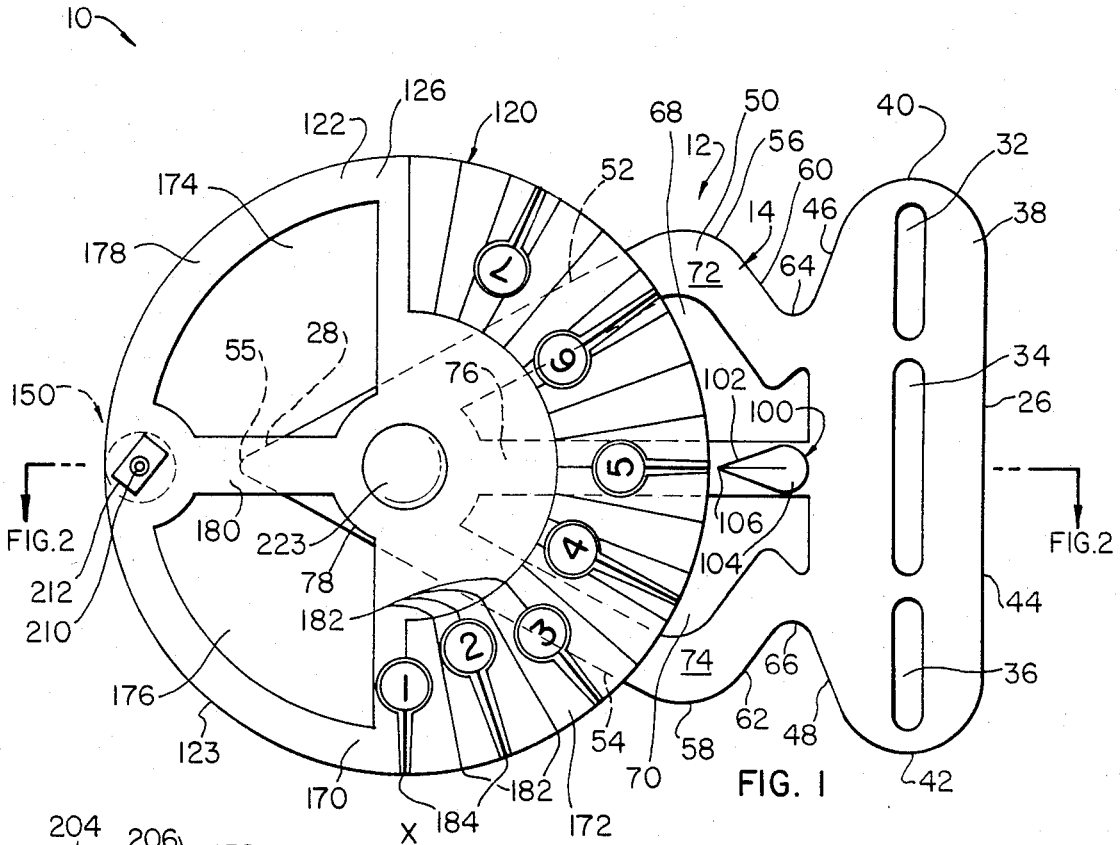
FIG. 1 is a side elevation view of a bow sight.

As illustrated in FIGS. 4 through 10, the present invention comprises a bow sight 10 for mounting on an archery bow 11. For purposes of reference herein, the portion of the bow immediately above the bow handle, generally referred to as the riser, is designated by the numeral 20. The side of the bow on which the arrow is mounted is designated by the numeral 13; the side of the bow opposite the arrow side is designated 15; the front of the bow is designated 17; and the rear of the bow is designated 19. Most modern bows are provided with an arrow rest 21 on side 13 positioned a small distance above the bow handle 23 for the purpose of supporting an arrow 22 on a flat surface having minimal frictional contact.

Figure 2:
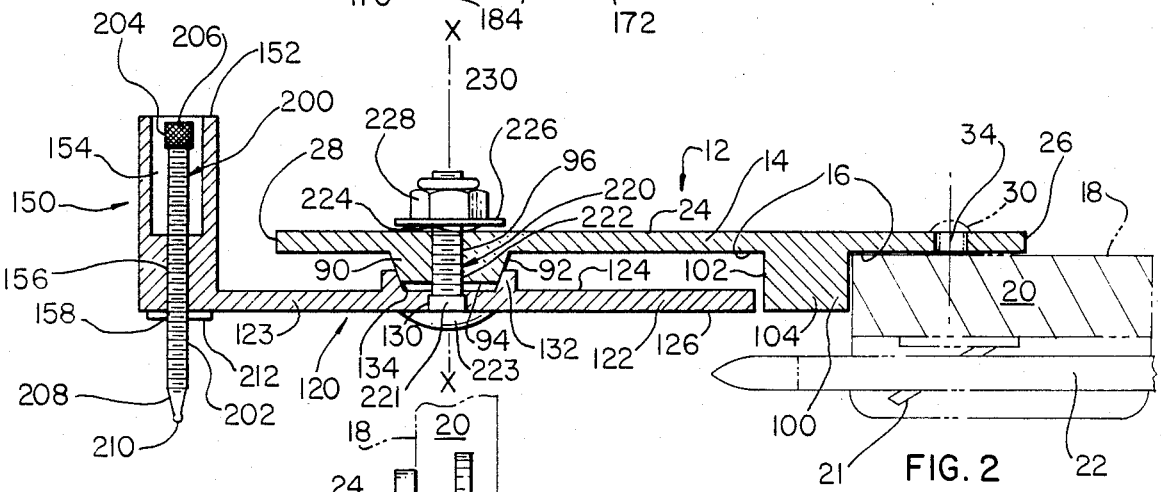
FIG. 2 is a cross-sectional plan view of the bow sight of FIG. 1.
Figure 3:
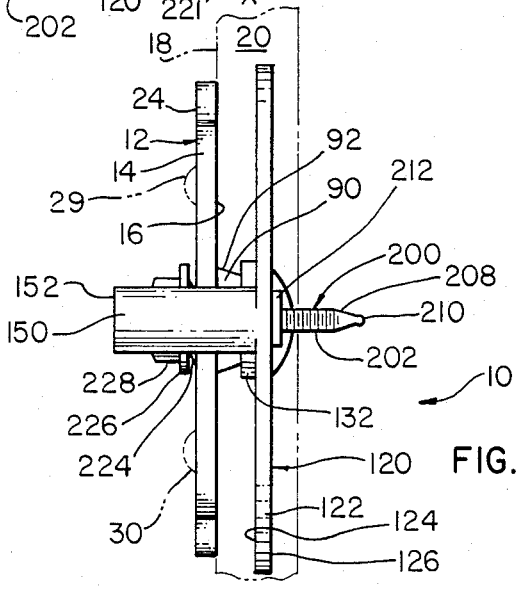
FIG. 3 is a front elevation view of the bow sight of FIGS. 1 and 2.

As best illustrated in FIGS. 1, 2 and 3, the bow sight may comprise a mounting bracket 12 comprising a flat body portion 14 (which may be, e.g. $\frac{1}{8}$ inch thick) having a substantially planar inside face surface 16 which is positionable in abutting contact with a flat surface 18 of a bow riser 20, FIG. 2. In the preferred embodiment, the mounting bracket is mounted on side 15 of the bow opposite the side on which the arrow is mounted. The flat body portion 14 also comprises a planar outside face surface 24 positioned opposite and parallel the inside face surface 16. The bracket body comprises a first end 26 and a second end 28. For purposes of reference herein, the first end 26 will be designated as "rearward" and the second end 28 will be designated as "forward", without regard to the position of the bracket relative the bow 11. A plurality of elongate slots 32, 34, 36 extending through the flat body portion are positioned at first end 26 of the flat body portion. In a preferred embodiment shown in FIG. 1, the flat body portion of the first end 26 comprises a generally ovoid shaped portion 38 having two opposite, relatively small radius, (e.g. $\frac{1}{2}$ inch radius) lateral edge surfaces 40, 42 integrally connected to by a relatively linear edge surface 44 (which with surfaces 40, 42 may comprise a total width of e.g. 3 and $\frac{3}{4}$ inches). Each small radius lateral edge surface 40, 42 is also integrally connected with an associated tangential edge surface 46, 48. The tangential edge surfaces 46, 48 are in turn connected to a generally arrowhead shaped body portion 50. The arrowhead shaped body portion comprises two forward edge surfaces 52, 54 positioned to intersect at an acute angle which are integrally connected by relatively small radius (e.g. 1/16 inch radius) edge surface 55. Relatively small radius (e.g. $\frac{1}{2}$ inch radius) curved portions 56, 58 are integrally connected to edge surfaces 52, 54 respectively at the ends thereof opposite the connection point with small radius edge 55. Each small radius curve edge surface 56, 58 is in turn connected to an associated short length tangential edge surface 60, 62. Edge surfaces 60, 62 are in turn integrally connected with edge surfaces 46, 48 of the ovoid portion by relatively small radius (e.g. $\frac{1}{8}$ inch radius) connection edges 64, 66. Cutout portions 68, 70 are provided in the bracket flat body portion 14 in an arrangement which defines substantially constant width outer members 72, 74, constant width inner member 76 positioned symmetrically between outer members 72, 74 and tip portion 78 integrally connecting the outer members 72, 74 and inner member 76.

A raised boss portion 90, FIGS. 2 and 3, which may be integrally formed with the flat body portion 14 projects perpendicularly a small distance (e.g. 3/16 inch) from the inside face 16 of the flat body portion and is positioned at the second end 28 of the flat body portion within the tip portion 78. The boss portion 90 has a generally truncated-cone shape with an axially outwardly, radially inwardly tapering peripheral surface portion 92 and a radially extending surface portion 94 (e.g. 5/16 inch radius) positioned parallel to the flat body face surfaces 16, 24. The boss portion 90 has a centrally positioned bore 96 (e.g. 0.25 inch diameter) therein which passes through the entire length of the boss portion and flat body portion in perpendicular relationship with face surfaces 16 and 24.

A pointer portion 100, which may be integrally formed with the flat body portion 14, is symmetrically positioned on the flat body portion forward of the aligned slots 32, 34, 36 and rearward of the boss portion 90. In the preferred embodiment, the pointer portion 100 projects perpendicularly from the inside face surface 16 at a rearward position on inner member 76. The pointer portion 100 may have a peripheral surface 102 oriented generally perpendicular to the flat body face surfaces 16, 24 and may have a pointer face surface 104 positioned substantially parallel the flat body face surfaces with a configuration having a pointed end 106 directed forwardly toward the boss portion 90.

As best illustrated by FIGS. 1 through 3, the bow sight 10 comprises a sight wheel 120 having a flat substantially circular wheel body portion 122 (which may be e.g. $\frac{1}{8}$ inch thick having e.g. a 2 inch radius). The wheel body portion comprises a wheel body inside face surface 124 which is positionable in spaced-apart adjacent relationship with the bracket body inside face surface 16. The wheel body portion 122 also comprises a wheel body outside face surface 126 positioned opposite and parallel to the wheel body inside face surface 124, and a circumferential edge surface 123 connecting the faces 124, 126. A wheel body central bore 130, FIG. 2, (which may be a square hole 9/32 inch on a side) is provided at the center of the wheel body 122 in coaxial alignment with the bracket boss portion central bore 96. A circular rib portion 132 is symmetrically positioned about the central bore 130, projecting perpendicularly a small distance (e.g. $\frac{1}{8}$ inch) from the wheel body inside face surface 124. The circular rib portion 132 has an inner rib surface 134 projecting axially outwardly and radially outwardly relative to the central axis of central bore 130. The conical inner rib surface 134 is adapted to receive and frictionally engage the conical peripheral wall surface 92 of the bracket boss portion 90 as will be described in further detail hereinafter.

A wheel cylindrical extension portion 150, which may be integrally formed with the wheel body portion 122, extends perpendicularly outwardly (e.g. 1 and $\frac{1}{8}$ inch) from the wheel 4body inside face surface 124. The cylindrical extension portion 150 has a relatively small radius (e.g. $\frac{1}{4}$ inch radius) relative the diameter of the wheel body portion 122. The cylindrical extension portion 150 is positioned at a circumferential portion of the wheel body and has a circular face surface 152 positioned distal the wheel body. A relatively large bore 154 (e.g. 3/16 inch radius) extends from the circular face surface 152 substantially half the length of the cylindrical extension portion 150. Beginning at the termination point of bore 154, a relatively small diameter tap bore 156 (e.g. 8/32 inch radius) is provided extending in coaxial alignment with the relatively large diameter bore 154 and passes through the remainder of the cylindrical extension portion 150 and also through the wheel body portion 122 to form a circular opening 158 on the wheel body outer face surface 126.

For purposes of reference, the wheel body portion 122 may be divided into a first semi-circular section 170 and a second semi-circular section 172. The first semi-circular section 170 comprises two cut out portions 174, 176 which are symmetrically positioned in two quadrants of the first semi-circular section 170. The cut outs 174, 176 define an arcuate support portion 178 (which may be e.g. 5/16 inch wide) around the periphery of the first semi-circular portion 170 and also define an interior arm portion 180 (which may be e.g. $\frac{3}{8}$ inch wide) positioned symmetrically between the two cut out portions. The wheel cylindrical extension portion 150 is positioned symmetrically within the first semi-circular section which, in the preferred embodiment, is at the point of intersection of the arcuate support portion 178 and the interior arm portion 180. The cut outs 174, 176 help balance the wheel, off setting the weight of extension 150.

The second semi-circular section 172 may be provided with radially projecting marks 182 on the outside face surface 126 thereof. In the preferred embodiment, the radially projecting marks 182 are symmetrically spaced along the circumference. The second semi-circular section 172 is also provided with an outside face surface 126 which is adapted to receive pressure sensitive adhesive material allowing adhesive markers 184 to be attached at pre-selected positions corresponding to calibration points as will be discussed in further detail hereinafter. Radially projecting marks 182 help the archer align markers 184 on the sight wheel.

An elongate sight pin 200 having a threaded exterior surface 202 is adapted to threadingly mate with the relatively small diameter tap bore 156 in the cylindrical extension portion 150 of the sight wheel 120. The sight pin 200 may have a roughened relatively large diameter portion 204 at a first end 206 thereof to facilitate screwing the pin in and out of bore 156 in order to adjust the position of the sight pin 200 for a particular bow or to further adjust it for wind, etc. during shooting. The pin has a tapered second end portion 208 having a relatively small diameter bead 210 at the terminal end thereof which is used for sighting. The sight pin may be provided with a sight pin nut 212 conventionally screwingly mounted thereon which may be positioned in abutting contact with the outside face surface 126 of the wheel body portion 122 to secure the pin 200 in a fixed position.

Attachment means are provided for rotatably attaching sight wheel 120 to the mounting bracket 12 for rotation about central axis x—x. In the preferred embodiment, the attachment means comprise a threaded bolt 220 with a cylindrical shaft 222 having a square upper portion 121 and a circular head 223. The bolt shaft 222 is of a diameter adapted to be closely received through the boss portion central bore 96 and upper portion 121 is adapted to non-rotatably mate with the wheel body portion central bore 130. An annular spring washer 224 for biasing the sight wheel rib portion 132 against the bracket boss portion 90 is annularly positioned about the threaded bolt shaft 222 in abutting contact with the bracket outer face surface 24. An annular flat washer 226 is positioned about the bolt shaft 222 adjacent the spring washer 224 and a nut 228 adapted to threadingly mount on the bolt shaft 222 is mounted at an end portion 230 of the bolt in abutting contact with the flat washer 226. By tightening or loosening the nut 228, the frictional contact force between the boss portion 90 and rib portion 132 may be selectively varied. In the preferred embodiment, a sufficient force is provided to prevent the sight wheel 120 from rotating relative the bracket 12 except when a substantial outside force is exerted on the sight wheel. This outside force will of course be provided by a person using his hand to move the sight wheel relative the bracket, preferably by grasping the sight wheel at cylindrical extension 150. The dimensions of the bracket and sight wheel are such that the pointer end 106 of pointer portion 100 is positioned in close proximity to the circumferential edge of the sight wheel. This arrangement allows a person using the bow sight 10 to rotate the wheel to predetermine positions relative the bracket by aligning marks 182, or adhesive markers 184, or relative positions between said marks or markers, with the point 106.

Figure 4:
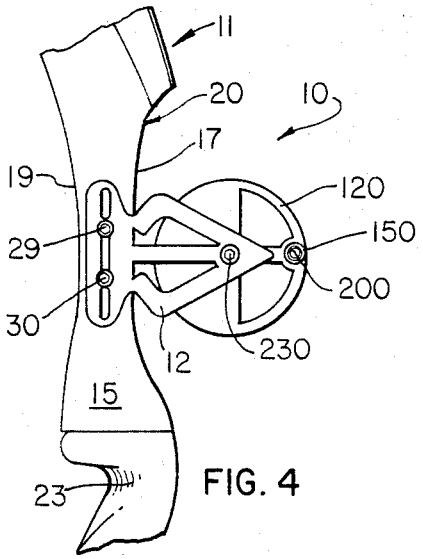
FIG. 4 is a side elevation view illustrating one mounting configuration of a bow sight of the present invention.
Figure 5:
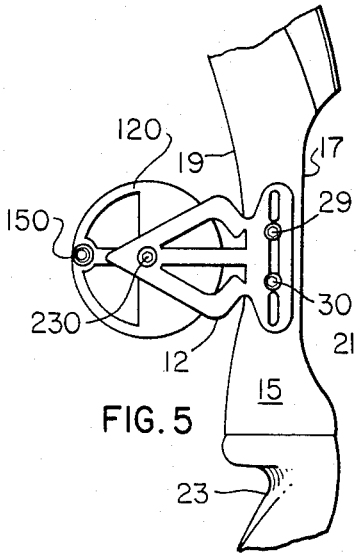
FIG. 5 is a side elevation view illustrating another mounting configuration of the bow sight of the present invention.
Figure 6:
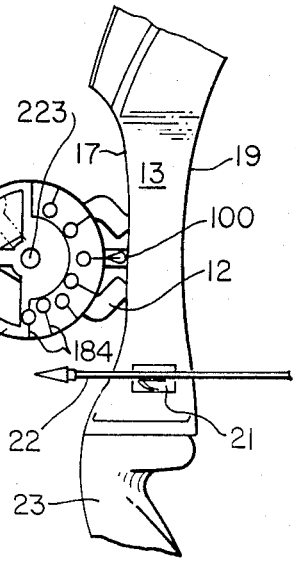
FIG. 6 is an opposite side elevation view from the side elevation view of FIG. 5.
Figure 7:
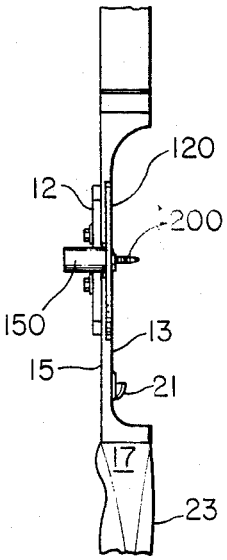
FIG. 7 is a front elevation view of yet another mounting configuration of the bow sight of the present invention.
Figure 8:
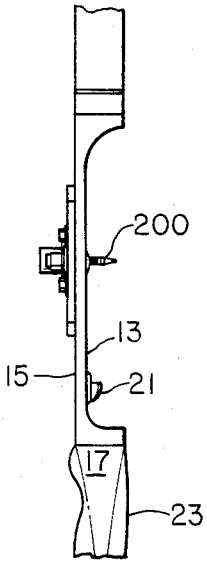
FIG. 8 is a front elevation view of still another mounting configuration of the bow sight of the present invention.

In use, as shown in FIGS. 4–8, the bow sight 10 is mounted on the bow riser 20 at the side 15 opposite the side 13 on which the arrow 22 is positioned. (Although the bracket 12 could be mounted on the same side 13 as the arrow, this arrangement would generally interfere somewhat with the archer's view of the target). The bracket 12 is mounted on the riser as by bolts 29, 30 received at opposite ends of central slot 34 and adapted to be threadingly received in spaced holes (not shown) provided in the bow riser. As illustrated by FIGS. 4, 6, and 7, the bracket may be positioned to project forwardly from the bow whereby the sight wheel 120 is positioned forward of the bow forward surface 17. The bracket may also be positioned to project rearwardly from the bow, FIGS. 5 and 8, whereby the sight wheel 120 is positioned rearward of the bow rear surface 19. The symmetrical construction of the bow sight 10 as described above facilitates this forward and rearward mounting feature. In addition, the symmetrical construction also allows the bow sight 10 to be used without modification on either left handed (not shown) or right handed bows 11.

Figure 9:
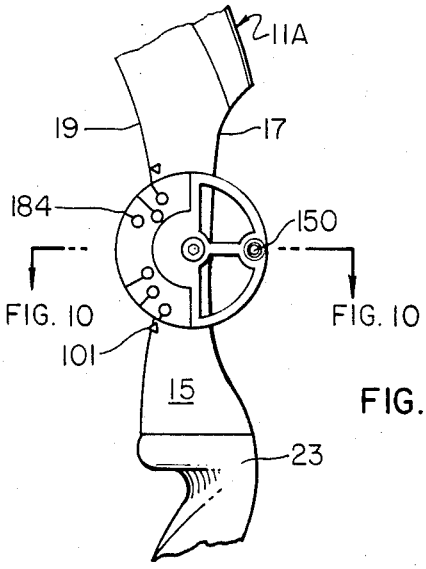
FIG. 9 is a side elevation view of the bow sight mounting configuration of FIG. 7.
Figure 10:
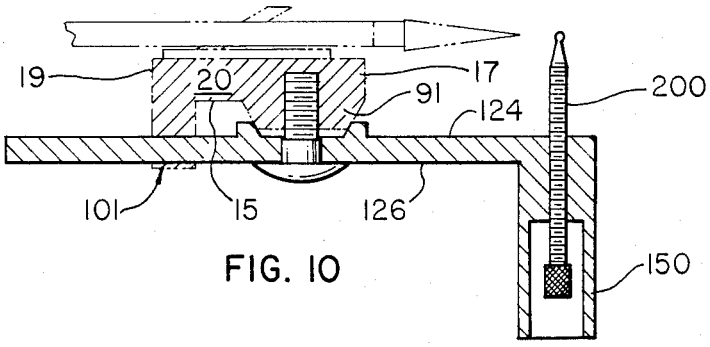
FIG. 10 is a cross-sectional view of the bow sight mounting configuration of FIGS. 7 and 9.

In a different embodiment of the invention as illustrated by FIGS. 9 and 10, the bow sight wheel 120 is provided on a specially constructed bow 11A having a boss portion 91 integrally formed with the bow riser on side 15 away from the arrow. A pointer 101 is also formed on the bow riser 20 and cooperates with the sight wheel 20 in the same manner as the bracket pointer 100 discussed above. The construction of the sight wheel 120 in this embodiment is identical to that in the above described embodiment, except that cylindrical extension 150 projects outwardly from wheel body outer face surface 126 rather than from inner face surface 124. Due to the fact that in this embodiment the sight wheel 120 is positioned somewhat more remotely from the arrow 22 as measured in a direction perpendicular to the arrow's flight path, the sight pin 200 which is provided in cylindrical extension 150, may be somewhat longer than the sight pin used in the previously described embodiment. Marks 182 and markers 184 will be positioned on outside face surface 126 in this embodiment.

The bracket 12 and sight wheel 120 as described herein may be constructed from any relatively high strength, substantially rigid, substantially non-breakable material such as sheet metal or high strength plastic. The attachment means and sight pin 200 may comprise machineable metal or other high strength machineable material.

In use, the bow sight mounted at a position on riser 20 at a vertical height relative the arrow rest 21 at which the sight 10 will most efficiently serve the needs of the archer using the bow. Generally, this position will be at a height where the sight pin 200, when rotated to a maximum elevation relative the arrow rest 21, is at a position corresponding to the shortest shooting distance at which the archer will use the bow. Ordinarily, this distance would be about 10 yards. Vertical slots 32, 34, 36 allow the sight 10 to be positioned upwardly or downwardly on the riser. After this initial up and down adjustment of the bracket relative the bow riser the sight 10 is calibrated for various distances, for example distances of 10 yards, 20 yards, 30 yards, 40 yards, etc. The bow sight is calibrated for each of these distances by the archer's shooting arrows at a selected distance and thereafter rotating the sight wheel 120 to cause relative changes in elevation of the sight pin 200 until finding the sight pin elevation suited to the particular distance involved. In general, the position of the sight pin is moved downwardly as the archer's distance from the target increases. As a sighting position is determined for each distance, a small sticker is attached to the sight wheel opposite the pointer 100. Alternately, a semi-circular piece of adhesive material may be provided along the peripheral edge of the second semi-circular portion 172 and the archer may simply make marks on the surface of the adhesive strip corresponding to the predetermined distances. In this manner, the bow is calibrated for a particular archer for a particular weight and type of arrow. One advantage of the bow sight 10 of the present invention is that a number of sight wheels 120 may be calibrated and used with the same mounting bracket 12. For example, one sight wheel might be calibrated for target arrows and a second sight wheel might be calibrated for hunting arrows. Thus, an archer may simply replace one sight wheel with another using the same bracket depending upon the particular type of shooting activity in which he is about to engage. Similarly, different archers using the same bow may substitute different sight wheels while using the same bracket mounting.

It is contemplated that the inventive concepts herein described may be variously otherwise embodied and it is intended that the appended claims be construed to include alternative embodiments of the invention except insofar as limited by the prior art.

What is claimed is:

1. A bow sight for use with an archery bow comprising:

(a) a mounting bracket having a flat body portion with an inside face positionable against an abutting surface of a bow riser and an outside face surface positioned opposite and parallel said inside face surface; a plurality of linearly aligned elongate slots extending through said flat body portion and positioned at a first end thereof;

a raised boss portion projecting perpendicularly from said inside face of said flat body portion and positioned at a second end of said flat body portion opposite said first end, said boss portion having a truncated conical surface with an axially outwardly radially inwardly tapering peripheral surface portion and a radially extending surface portion positioned parallel said faces of said flat body portion; said boss portion having a centrally positioned bore passing therethrough in perpendicular relationship with said flat body face surfaces of said body portion;

a pointer portion positioned between said aligned slots and said boss portion said pointer portion projecting perpendicularly from said inside face surface of said flat body portion and having a pointer peripheral surface oriented generally perpendicular said flat body face surfaces and having a pointer face surface positioned substantially parallel said flat body outside face surface with a configuration having a pointed end directed toward said boss portion;

(b) at least one sight wheel having a flat substantially circular body portion having a circumferential edge surface and housing a wheel body inside face surface positionable in spaced apart adjacent relationship with said bracket body inside face surface and having a wheel body outside face surface positioned opposite and parallel said wheel body inside face surface; said wheel body having a wheel body central bore provided at the center of said wheel body in coaxial alignment with said bracket boss portion central bore;

a circular rib portion symmetrically positioned about said central bore and projecting perpendicularly from said wheel body inside face surface, said circular rib portion having an inner rib surface projecting axially outwardly and radially outwardly relative the central axis of said central bore; said inner rib surface being adapted to receive and frictionally engage said peripheral wall surface of said bracket boss portion;

a wheel cylindrical extension portion extending perpendicularly outwardly from said wheel body inside face surface, said cylindrical extension portion having a relatively small diameter relative the diameter of said wheel body portion and being positioned at a circumferential portion of said wheel circular body, said cylindrical extension portion having a circular face surface, and having a relatively large diameter bore extending from said circular face surface substantially half the length of said cylindrical extension and having a relatively small diameter tapped bore extending in coaxial alignment with said relatively large diameter bore through the remainder of said cylindrical extension portion and said through wheel body portion whereby a circular opening is provided on said wheel body outer face surface; said wheel body portion comprising a first semicircular section and a second semicircular section opposite said first semicircular section, said first semicircular section comprising two symmetrically positioned wheel cut out portions in quadrants thereof; said wheel cylindrical extension portion being positioned symmetrically within said first semicircular section between said wheel cut out portions; said outside face surface of said wheel body portion having radially projecting marks on the surface thereof in said second semicircular section and having an outside surface adapted to accept pressure sensitive adhesive material;

(c) a sight pin having a threaded exterior surface adapted to threadingly mate with said relatively small diameter tapped bore in said cylindrical extension portion of said sight wheel, said sight pin having a roughened relatively large diameter portion at a first end thereof to facilitate screwingly adjusting the position of said sight pin relative said cylindrical extension portion of said sight wheel, and having a tapered second end portion having a relatively small diameter bead at the terminal end thereof, said sight pin having a sight pin nut mounted thereon and abuttingly contacting said outside face surface of said wheel body portion;

(d) attachment means for rotatably attaching said sight wheel to said mounting bracket comprising a threaded bolt adapted to be received through said boss portion central bore and said wheel body portion central bore; an annular spring washer for biasing said sight wheel rib portion against said bracket boss portion positioned about said threaded bolt in abutting contact with said bracket outer face surface; an annular flat washer positioned about said bolt adjacent said spring washer; and a nut threadingly mounted at an end portion of said bolt in abutting contact with said flat washer; whereby a biasing force between said bracket and said sight wheel is adjustable by selective tightening or loosening of said nut on said bolt; and (e) pressure sensitive adhesive markers mounted on said outside face surface of said wheel body portion within said second semicircular section at predetermined, calibrated positions thereon;

(f) said sight wheel and said bracket being constructed and arranged whereby said pointed end of said pointer portion is positioned in closely spaced relationship relative the circumferential edge surface of said wheel body portion.

2. An archery bow and bow sight assembly comprising:

an archery bow having a handle portion and a riser portion mounted above said handle portion, said riser portion having an arrow receiving side and a nonarrow receiving side positioned opposite said arrow receiving side; and a bow sight mounted on said archery bow comprising:

(a) a mounting bracket having a flat body portion with an inside face positioned in abutting contact with said nonarrow receiving side of said bow riser portion and an outside face surface positioned opposite and parallel said inside face surface; a plurality of linearly aligned elongate slots extending through said flat body portion and positioned at a first end thereof;

a raised boss portion projecting perpendicularly from said inside face of said flat body portion and positioned at a second end of said flat body portion opposite said first end, said boss portion having a truncated conical surface with an axially outwardly radially inwardly tapering peripheral surface portion and a radially extending surface portion positioned parallel said faces of said flat body portion; said boss portion having a centrally positioned bore passing therethrough in perpendicular relationship with said flat body face surfaces of said body portion;

a pointer portion positioned between said aligned slots and said boss portion said pointer portion projecting perpendicularly from said inside face surface of said flat body portion and having a pointer peripheral surface oriented generally perpendicular said flat body face surfaces and having a pointer face surface positioned substantially parallel said flat body outside face surface with a configuration having a pointed end directed toward said boss portion;

(b) at least one sight wheel having a flat substantially circular body portion having a circumferential edge surface and housing a wheel body inside face surface positionable in spaced apart adjacent relationship with said bracket body inside face surface and having a wheel body outside face surface positioned opposite and parallel said wheel body inside face surface; said wheel body having a wheel body central bore provided at the center of said wheel body in coaxial alignment with said bracket boss portion central bore;

a circular rib portion symmetrically positioned about said central bore and projecting perpendicularly from said wheel body inside face surface, said circular rib portion having an inner rib surface projecting axially outwardly and radially outwardly relative the central axis of said central bore; said inner rib surface being adapted to receive and frictionally engage said peripheral wall surface of said bracket boss portion;

a wheel cylindrical extension portion extending perpendicularly outwardly from said wheel body inside face surface, said cylindrical extension portion having a relatively small diameter relative the diameter of said wheel body portion and being positioned at a circumferential portion of said wheel circular body, said cylindrical extension portion having a circular face surface, and having a relatively large diameter bore extending from said circular face surface substantially half the length of said cylindrical extension and having a relatively small diameter tapped bore extending in coaxial alignment with said relatively large diameter bore through the remainder of said cylindrical extension portion and said through wheel body portion whereby a circular opening is provided on said wheel body outer face surface; said wheel body portion comprising a first semicircular section and a second semicircular section opposite said first semicircular section, said first semicircular section comprising two symmetrically positioned wheel cut out portions in quadrants thereof; said wheel cylindrical extension portion being positioned symmetrically within said first semicircular section between said wheel cut out portions; said outside face surface of said wheel body portion having radially projecting marks on the surface thereof in said second semicircular section and having an outside surface adapted to accept pressure sensitive adhesive material;

(c) a sight pin having a threaded exterior surface adapted to threadingly mate with said relatively small diameter tapped bore in said cylindrical extension portion of said sight wheel, said sight pin having a roughened relatively large diameter portion at a first end thereof to facilitate screwingly adjusting the position of said sight pin relative said cylindrical extension portion of said sight wheel, and having a tapered second end portion having a relatively small diameter bead at the terminal end thereof, said sight pin having a sight pin nut mounted thereon and abuttingly contacting said outside face surface of said wheel body portion;

(d) attachment means for rotatably attaching said sight wheel to said mounting bracket comprising a threaded bolt adapted to be received through said boss portion central bore and said wheel body portion central bore; an annular spring washer for biasing said sight wheel rib portion against said bracket boss portion positioned about said threaded bolt in abutting contact with said bracket outer face surface; an annular flat washer positioned about said bolt adjacent said spring washer; and a nut threadingly mounted at an end portion of said bolt in abutting contact with said flat washer; whereby a biasing force between said bracket and said sight wheel is adjustable by selective tightening or loosening of said nut on said bolt; and (e) pressure sensitive adhesive markers mounted on said outside face surface of said wheel body portion within said second semicircular section at predetermined, calibrated positions thereon;

(f) said sight wheel and said bracket being constructed and arranged whereby said pointed end of said pointer portion is positioned in closely spaced relationship relative the circumferential edge surface of said wheel body portion.

3. The invention of claim 2 wherein said bow sight projects rearwardly from said bow riser portion.

4. The invention of claim 2 wherein said bow sight projects forwardly from said bow riser portion.

5. An archery bow and bow sight assembly comprising:

a. an archery bow having a riser portion positioned above a handle portion, the riser portion having an arrow receiving side and a nonarrow receiving side, said nonarrow receiving side of said bow comprising:

sight wheel mounting means for rotatably mounting a sight wheel thereon;

pointer means for providing a fixed comparative reference point proximate a circumferential edge portion of said sight wheel means;

b. sight wheel means mounted for rotation about a central rotational axis for supporting a sight pin thereon;

sight wheel attachment means for rotatably attaching said sight wheel to said sight wheel mounting means; and sight wheel marking means for cooperating with said pointer means for indicating rotational orientations of said sight wheel means relative said bow riser whereby said sight wheel means is repeatingly selectively positional at a plurality of predetermined rotational orientation relative said bow riser.

6. A bow sight for use with an archery bow comprising:

a. bracket means for mounting said bow sight on a lateral surface of a bow riser;

b. sight wheel means operably mounted on said bracket means for selective incrimental rotation relative said bracket means about a central rotational axis positioned perpendicular the trajectory of an arrow shot from the bow, said sight wheel means having an exposed outer face surface;

c. sight pin means operably mounted on said sight wheel means for providing a sighting point for use by an archer in aiming the bow;

d. attachment means for operably rotatably attaching said sight wheel means to said bracket means;

e. biasing means for frictionally biasing said sight wheel means against rotation relative said bracket means; and f. a plurality of marker means for calibrating said bow sight for a plurality of shooting distances selectively mounted in predetermined position about a circumferential portion of said sight wheel means exposed outer face surface whereby all of said marker means are continuously exposed to an archer adjusting the bow sight.

7. The invention of claim 6 wherein said bracket means comprises unitary pointer means positioned in closely spaced relationship with said sight wheel means for providing a single fixed comparative reference point proximate said circumferential portion of said sight wheel means and alignable with said marker means whereby said sight wheel means is repeatingly, selectively, positionable at predetermined rotational positions relative said bracket means by alignment of selected ones of said plurality of marker means with said pointer means.

8. The invention of claim 6 wherein said bracket means comprises:

a. a flat body portion with an inside face positionable against an abutting surface of a bow riser and an outside face surface positioned opposite and parallel said inside face surface; a plurality of linearly aligned elongate slots extending through said flat body portion and positioned at a first end thereof;

a raised boss portion projecting perpendicularly from said inside face of said flat body portion and positioned at a second end of said flat body portion opposite said first end, said boss portion having a truncated conical surface with an axially outwardly radially inwardly tapering peripheral surface portion and a radially extending surface portion positioned parallel said faces of said flat body portion; said boss portion having a centrally positioned bore passing therethrough in perpendicular relationship with said flat body face surfaces of said body portion;

a pointer portion positioned between said aligned slots and said boss portion said pointer portion projecting perpendicularly from said inside face surface of said flat body portion and having a pointer peripheral surface oriented generally perpendicular said flat body surfaces and having a pointer face surface positioned substantially parallel said flat body outside face surface with a configuration having a pointed end directed toward said boss portion.

9. The invention of claim 8 wherein said sight wheel means comprises;

a flat substantially circular wheel body portion having a circumferential edge surface and having a wheel body inside face surface positionable in spaced apart adjacent relationship with said bracket body outside face surface and having an exposed wheel body outside face surface positioned opposite and parellel said wheel body inside face surface; said wheel body portion having a wheel body central bore provided at the center of said wheel body in coaxial alignment with said bracket boss portion central bore;

a circular rib portion symmetrically positioned about said central bore and projectingly perpendicularly from said wheel body inside face surface, said circular rib portion having an inner rib surface projecting axially outwardly and radially outwardly relative the central axis of said central bore; said inner rib surface being adapted to receive and frictionally engage said peripheral wall surface of said bracket boss portion; and a wheel cylindrical extention portion extending perpendicularly outwardly from said wheel body and housing said sight pin means.

10. The invention of claim 9 wherein said marker means comprise:

pressure sensitive adhesive markers mounted on said exposed outer face surface of said sight wheel means.

11. The invention of claim 6 wherein said sight wheel means comprises sight pin attachment means positioned at a circumferential portion of said sight wheel means whereby said sight pin means is relatively elevationally adjustable relative said bow riser by selective rotational movement of said sight wheel means relative said bracket means.

12. The invention of claim 11 wherein said sight pin means is laterally adjustable relative said bow riser.

13. The invention of claim 6 wherein said bracket means and said sight wheel means each comprises a substantially flat body having planar faces positioned in parallel alignment with the trajectory of an arrow to be shot from the bow.

14. The invention of claim 6 comprising:

a raised boss portion in one of said bracket means and said sight wheel means;

a circular rib portion in one of said bracket means and said sight wheel means not having said raised boss portion, said raised boss portion being received in frictional engagement with said circular rib portion.

15. The invention of claim 14 wherein said biasing means comprises a spring washer.

16. The invention of claim 15 wherein said attachment means comprises a bolt, said spring washer being received about said bolt.

17. The invention of any one of claims 14-16, said boss portion having a truncated conical surface with an axially outwardly radially inwardly tapering peripheral surface portion and a radially extending surface portion; said boss portion having a centrally positioned bore passing therethrough; said circular rib portion having an inner rib surface projecting axially outwardly and radially outwardly relative the central axis of a central bore passing through said circular rib portion; said inner rib surface being adapted to receive and frictionally engage said peripheral surface portion of said boss portion.

18. The invention of claim 5, said sight wheel means having an exposed outer face surface, all of said sight wheel marking means being mounted on a circumferential portion of said exposed outer face surface whereby all of said marker means are continuously exposed to an archer adjusting the bow sight.

* * * * *